US007757481B2

(12) United States Patent
Ryan et al.

(10) Patent No.: US 7,757,481 B2
(45) Date of Patent: Jul. 20, 2010

(54) ENCLOSED VOLUME EXHAUST DIFFUSER APPARATUS, SYSTEM, AND METHOD

(75) Inventors: Michael E. Ryan, Columbus, IN (US); J. David Dixon, Greenwood, IN (US); Patrick M. Klein, Madison, WI (US)

(73) Assignee: Cummins Filtration IP, Inc, Minneapolis, MN (US)

( * ) Notice: Subject to any disclaimer, the term of this patent is extended or adjusted under 35 U.S.C. 154(b) by 1187 days.

(21) Appl. No.: 11/333,136

(22) Filed: Jan. 17, 2006

(65) Prior Publication Data

US 2007/0163247 A1 Jul. 19, 2007

(51) Int. Cl.
*F01N 3/00* (2006.01)

(52) U.S. Cl. ..... 60/298; 60/274; 60/297; 60/320; 60/324

(58) Field of Classification Search ..... 60/274, 60/295, 297, 298, 320, 324
See application file for complete search history.

(56) References Cited

U.S. PATENT DOCUMENTS

| | | | | |
|---|---|---|---|---|
| 2,370,062 | A | 2/1945 | Mercier | |
| 2,858,853 | A | 11/1958 | Lyon | |
| 2,919,720 | A | 1/1960 | Nicholls | |
| 3,605,389 | A * | 9/1971 | Buttler | 55/482.1 |
| 3,741,730 | A * | 6/1973 | Alcott | 422/173 |
| 4,066,214 | A | 1/1978 | Johnson | |
| 4,077,206 | A | 3/1978 | Ayyagari | |
| 4,685,534 | A * | 8/1987 | Burstein et al. | 181/251 |
| 4,719,751 | A | 1/1988 | Kume et al. | |
| 4,909,346 | A | 3/1990 | Torkelson | |
| 5,058,704 | A | 10/1991 | Yu | |
| 5,611,203 | A | 3/1997 | Henderson et al. | |
| 5,755,092 | A | 5/1998 | Dessale et al. | |
| 5,884,472 | A | 3/1999 | Presz, Jr. et al. | |
| 6,021,639 | A * | 2/2000 | Abe et al. | 60/297 |
| 6,233,920 | B1 | 5/2001 | Presz, Jr. et al. | |
| 6,425,382 | B1 | 7/2002 | Marthaler et al. | |
| 6,443,675 | B1 | 9/2002 | Kopras et al. | |
| 6,651,773 | B1 * | 11/2003 | Marocco | 181/270 |
| 6,776,146 | B1 | 8/2004 | Ricart-Ugaz et al. | |
| 6,810,867 | B2 | 11/2004 | Schmid et al. | |
| 6,889,673 | B2 | 5/2005 | Bender et al. | |
| 6,910,550 | B2 | 6/2005 | Schlossarczyk et al. | |
| 6,968,680 | B2 | 11/2005 | van Nieuwstadt et al. | |

(Continued)

FOREIGN PATENT DOCUMENTS

| | | | |
|---|---|---|---|
| CN | 2443152 | Y | 8/2001 |

OTHER PUBLICATIONS

CN 200780002423.5 Office Action, Feb. 12, 2010.

*Primary Examiner*—Tu M Nguyen
(74) *Attorney, Agent, or Firm*—Kunzler Needham Massey & Thorpe

(57) ABSTRACT

An apparatus, system, and method for cooling exhaust gases includes an inlet operatively connected to an exhaust port from a diesel engine or the like, and a housing defining a substantially enclosed volume. At least a portion of the volume is larger in cross-section than the inlet in cross-section, such that the exhaust gases expand upon entering the housing from the inlet. At least one outlet larger in collective cross-section than the inlet in cross-section is disposed on the housing and configured to expel the exhaust gases from the housing into the atmosphere.

26 Claims, 5 Drawing Sheets

U.S. PATENT DOCUMENTS

| | | | | |
|---|---|---|---|---|
| 7,028,663 | B1 | 4/2006 | Kim | |
| 7,266,943 | B2 * | 9/2007 | Kammel | 60/297 |
| 7,316,109 | B2 * | 1/2008 | Clerc et al. | 60/311 |
| 7,461,506 | B2 * | 12/2008 | McNally et al. | 60/320 |
| 2006/0112683 | A1 | 6/2006 | Huber | |
| 2006/0266022 | A1 * | 11/2006 | Woerner et al. | 60/295 |
| 2007/0039318 | A1 | 2/2007 | Krajewski et al. | |
| 2007/0095057 | A1 | 5/2007 | Field et al. | |
| 2007/0163247 | A1 | 7/2007 | Ryan et al. | |
| 2008/0099276 | A1 | 5/2008 | Bach | |

* cited by examiner

ENCLOSED VOLUME EXHAUST DIFFUSER APPARATUS, SYSTEM, AND METHOD

BACKGROUND OF THE INVENTION

1. Field of the Invention

This invention relates to exhaust systems, and more particularly to apparatuses, systems, and methods for cooling exhaust gas as it leaves an enclosed exhaust stream.

2. Description of the Related Art

This patent application is related to patent application serial number <serial number> titled "Lobed Exhaust Diffuser Apparatus, System, and Method," filed on the same date as the present patent application, and which is incorporated herein in its entirety.

Environmental regulations are becoming increasingly strict with regard to engine exhaust emissions such as nitrogen oxides (NOx) and particulate matter. In the United States, the U.S. Environmental Protection Agency will begin enforcing new, more stringent, environmental regulations with regard to diesel engine particulate emissions in 2007, which has occasioned the need for diesel particulate filters and/or other exhaust treatment devices such as NOx adsorbers to be placed in the exhaust stream before the exhaust is permitted to enter the atmosphere.

In most cases, an exhaust treatment system must initiate regeneration of particulate filters, NOx adsorbers, and other exhaust treatment devices from time to time as the devices fill up with soot, NOx, or the like. In the case of a particulate filter, as one example, this is done by increasing the temperature of the filter to a level where the soot is oxidized, above 400 C, and maintaining that temperature for several minutes or longer, depending on circumstances including the size of the filter, the amount of soot on the filter, the uniformity level of the soot, etc.

The high filter temperatures required for regenerations of this type increase the temperature of the exhaust, particularly at stationary or low-speed operation, meaning the exhaust leaves the tailpipe of the vehicle at a much higher temperature than it would during normal operation. This creates a potential safety hazard with regard to the heat flux of the gases leaving the tailpipe and creating discomfort or injury to humans, animals, or plants in proximity. It also increases the surface temperature of exhaust train components.

One way to deal with the problem would be to warn the operator of the vehicle or machine in which the engine and exhaust treatment system is installed of expelled exhaust temperatures reaching dangerous levels, enabling the operator to take steps to mitigate the situation, such steps potentially including moving the apparatus away from sensitive objects, initiating a cooling procedure, etc. This, however, would require detailed and expensive sensors and controls, would require operator intervention, and in any case the mitigation options for the operator would be relatively limited. If possible, it would be better that the exhaust gas be continually cooled before or as it leaves the tailpipe such that its temperatures never reach dangerous levels in the first place.

Treating exhaust to mitigate harmful consequences is nothing new, of course: mufflers and resonance filters have existed for decades for sound mitigation, and catalyst filters, particulate filters and the like have been and are being developed for substance emission control. The general problem of heat mitigation as the exhaust enters the atmosphere, however, is a relatively new one requiring novel approaches. The problem has been addressed in certain limited circumstances, such as exhaust temperature mitigation of fire trucks when they are pumping water. Some fire trucks (though not all) are equipped with a water spray device at the exhaust outlet for exhaust cooling, but such a scheme is limited to a situation where there is a ready water supply as well as experienced firefighters with hoses in hand rather than a single machine operator inexperienced in such situations.

From the foregoing discussion, it should be apparent that a need exists for cooling exhaust gases as they leave the tailpipe of an engine-driven machine, particularly one containing a diesel engine and particulate filter or other treatment device requiring regeneration. Certain types of vocational vehicles not using the emissions control devices discussed above can also benefit from cooled exhaust gases.

SUMMARY OF THE INVENTION

The present invention has been developed in response to the present state of the art, and in particular, in response to the problems and needs in the art that have not yet been fully solved by currently available systems. Accordingly, the present invention has been developed to provide an apparatus, system, and method for cooling exhaust gases that overcome many or all shortcomings in the art.

In one aspect of the invention, an apparatus for cooling exhaust gases includes an inlet operatively connected to a source of exhaust gases and a housing defining a substantially enclosed volume. At least a portion of the volume is larger in cross-section than the inlet in cross-section. The housing is configured to receive the exhaust gases through the inlet. An outlet larger in cross-section (meaning herein cross-sectional area) than the inlet in cross-section is disposed on the housing and configured to expel the exhaust gases from the housing into the atmosphere. In one embodiment, the outlet comprises a plurality of outlets, which in collective cross-section are greater than the inlet in cross-section.

In a further aspect of the invention, a method of cooling exhaust gases includes urging the gases through a first passage, urging the gases from the first passage into a substantially enclosed volume, allowing the gases to expand within the volume, and urging the gases from the enclosed volume, through an outlet greater in cross-section than the first passage, to the atmosphere. In one embodiment, the method also includes slowing the collective velocity of the exhaust gases within the enclosed volume.

In a further aspect of the invention, a diesel engine exhaust treatment and cooling system includes an exhaust pipe substantially containing and directing exhaust gases generated by the engine and an exhaust treatment mechanism disposed on the exhaust pipe. The exhaust treatment mechanism is configured to modify the composition of the exhaust gases. A regeneration mechanism is operatively attached to the exhaust treatment mechanism, the regeneration mechanism configured to regenerate the exhaust treatment mechanism from time to time. A cooling mechanism is disposed on the exhaust pipe downstream of the exhaust treatment mechanism. The cooling mechanism includes a substantially enclosed volume, a part of which is greater in cross-section than the exhaust pipe in cross-section. The cooling mechanism further includes a plurality of outlets through which the exhaust gases enter the atmosphere.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Discussion of the features and advantages, and similar language, throughout this specification may, but do not necessarily, refer to the same embodiment.

The described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention. These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention will be rendered by reference to specific embodiments illustrated in the appended drawings, which depict only typical embodiments of the invention and are not to be considered limiting of its scope, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Appearances of the phrases "in one embodiment," "in an embodiment," and similar language throughout this specification may, but do not necessarily, all refer to the same embodiment.

The described features, structures, or characteristics of the invention may be combined in any suitable manner in one or more embodiments. In the following description, numerous specific details are provided to impart a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
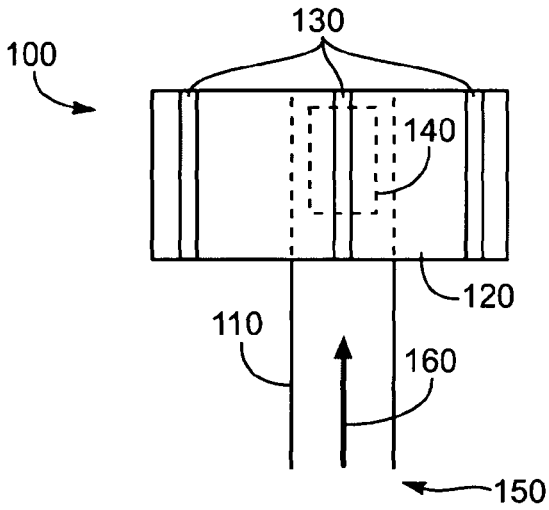
FIG. 1 is a rear elevational view of one embodiment of an exhaust gas diffuser according to the present invention.
Figure 2:
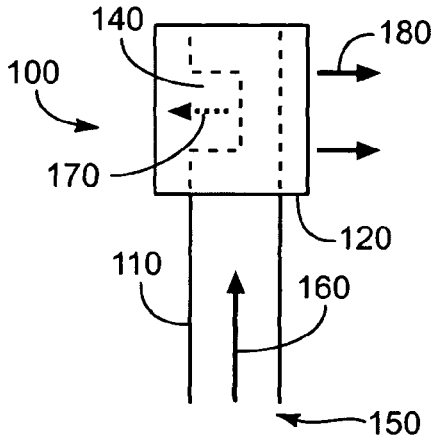
FIG. 2 is a side elevational view of the exhaust gas diffuser of FIG. 1.

FIGS. 1 and 2 illustrate one embodiment of an enclosed volume exhaust gas diffuser 100 according to the present invention, used with and operatively connected to a diesel engine emitting exhaust gases. The diffuser 100 comprises an exhaust pipe 110 and an enclosed volume housing 120, the housing 120 defining a volume in the shape of an elongated cube. The housing 120 has three slots 130 disposed in the housing 120 in the same axial direction as the exhaust pipe 110. Along with other modifications that will be apparent to those skilled in the art in light of this disclosure, more or fewer slots in different orientations are possible in other embodiments. The exhaust pipe 110 extends into the housing 120, with an opening 140 opening into the internal housing volume as its sole outlet. The diffuser 100 in one embodiment may be seen as primarily the housing 120 with its internal and external structure, with the exhaust pipe 110 serving as the diffuser inlet, and the slots 130 serving collectively as the diffuser outlet.

A proximal end 150 of the exhaust pipe 110 may be unitary with the rest of the exhaust train, may attach to an existing length of exhaust pipe, or attach directly to an exhaust treatment device, as desired and as circumstances and construction of the particular machine dictate, the exhaust treatment device modifying or enhancing the composition of the exhaust. The exhaust pipe 110 may be connected to an existing tailpipe, extending the tailpipe, or be constructed together with the rest of the exhaust train, making the exhaust pipe 110 and housing 120 themselves collectively the original tailpipe, with similar results in operation. A regeneration mechanism is operatively attached to the exhaust treatment device to regenerate the exhaust treatment device from time to time.

The exhaust pipe 110 in one embodiment is four inches in diameter, standard in the art. The housing 120 in one embodiment is 12 inches high, 15 inches long, and 8 inches wide, with the slots 130 being each 12 inches long and 1 inch wide, resulting in a total outlet area of 36 square inches. It can be seen that the outlet area defined by the slots 130 is almost three times that of the cross-sectional area of the exhaust pipe 110, which with a 4-inch diameter is approximately 12.5 inches. Additionally, it can be seen that the volume of the housing 120 is much greater than the volume of the exhaust pipe 110 of the same height. The housing 120 can be varied in size and shape for adaptation to a 5-inch-diameter pipe; other sizes and shapes will be apparent to those skilled in the art in light of this disclosure.

The exhaust pipe 110 and housing 120 are constructed of steel or other suitable material, such as aluminum.

The diffuser 100 may be preceded in the exhaust train by one or more exhaust treatment mechanisms, an aspirating flow apparatus (known in the art), or other devices, and may be connected directly thereto or spaced from such devices by piping of variable length.

In operation, exhaust generated by the engine enters the exhaust pipe 110 in the direction of the arrow 160, whence it travels into the housing 120 volume through the opening 140, which in one embodiment is relatively large compared to the exhaust pipe 110 diameter, as depicted by the arrow 170. Moving from the relatively small volume of the exhaust pipe 110 into the relatively large volume of the housing 120, the exhaust gases expand and slow within the volume. The exhaust leaves the housing 120 through the slots 130, generally in the direction of the arrows 180, and enters the atmosphere.

The diffuser 100 may be used in the orientation shown in FIGS. 1 and 2 for on-highway trucks, or in the same or different orientations for other types of machines. Its dimensions and shape may also be varied according to the requirements of the particular application, such as the space available, aerodynamic concerns, etc. The primary factor is enabling the exhaust gases to expand within the enclosed volume, in one embodiment being carried out by having the housing 120 define an enclosed volume greater than a comparable volume of the inlet to the housing, the exhaust gases leaving the housing 120 via an outlet or outlets greater in collective cross-sectional area than the cross-sectional area of the inlet. In one embodiment, the outlet or outlets are smaller in cross-sectional area than at least a portion of the housing in cross-section.

In one embodiment, a plurality of outlets such as the slots 130 have increased collective circumference and provide for increased intersection with the atmosphere than would, say, a single cylindrical outlet of comparable area, improving entrainment of atmospheric gases and diffusion and cooling of the exhaust gases. Other embodiments include a single outlet, or a single outlet with lobes, as described in the related application noted above.

The slowing of the exhaust gas velocity in the housing 120 improves entrainment, since the stationary or slower-moving atmospheric gases have to gain less velocity to catch up with the exhaust gases and entrain therein.

Figure 3:
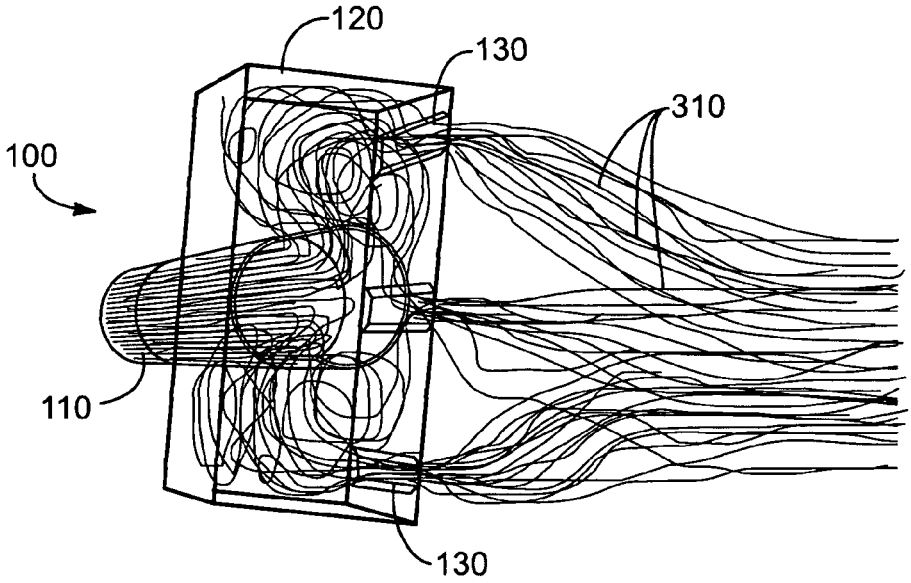
FIG. 3 is a perspective, schematic view from above of the exhaust gas diffuser of FIG. 1, showing exhaust gas flow stream lines.

FIG. 3 shows the results of a computational fluid dynamics (CFD) modeling of the diffuser 100, showing exhaust flow stream lines 310. As can be seen by the direction and density of the lines 310, the exhaust gases flow through the exhaust pipe 110, enter the housing 120 through the opening 140, and expand into the housing 120 before being expelled into the atmosphere through the slots 130.

Figure 4:
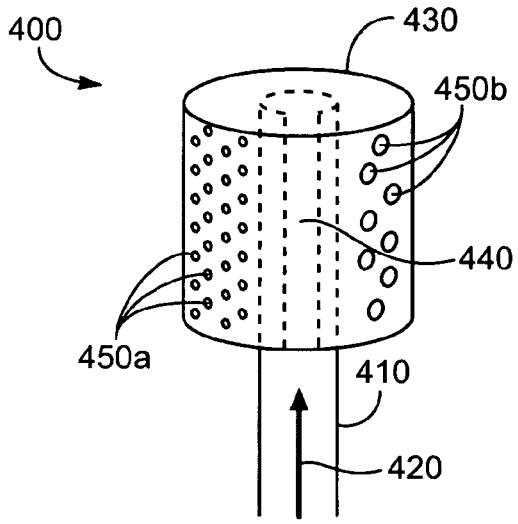
FIG. 4 is a perspective view of another embodiment of an exhaust gas diffuser according to the present invention.

FIG. 4 illustrates another embodiment of a diffuser 400 according to the present invention. The diffuser 400 contains a generally cylindrical inlet passage 410, through which exhaust gases flow in the direction of the arrow 420. The inlet passage 410 enters and extends into a generally cylindrical housing 430, allowing the exhaust gases to enter the housing 430 through an opening 440. The exhaust gases expand and slow inside the housing 430, whence they enter the atmosphere through a series of apertures 450*a* and 450*b*. The apertures 450*a* are relatively small, while the apertures 450*b* are relatively large—either aperture size, or both, may be used on the entire outer surface of the housing 430, or only a part of the housing surface, as desired and/or needed for the particular application.

Figure 5:
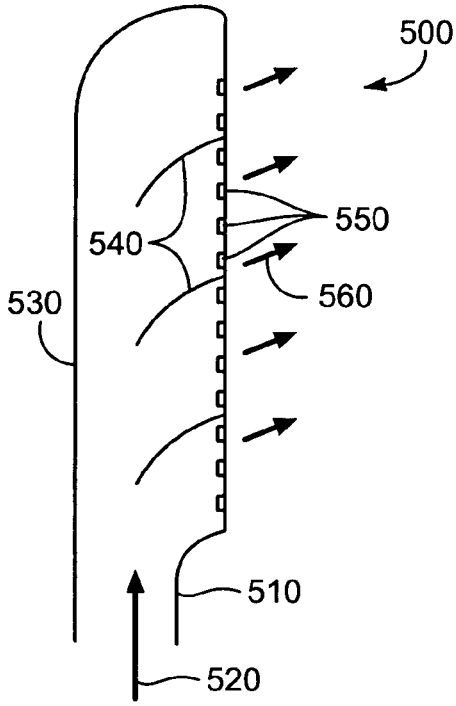
FIG. 5 is a side elevational view of an embodiment of an elongate exhaust gas diffuser according to the present invention.

FIG. 5 illustrates an embodiment of an elongate diffuser 500 according to the present invention, the diffuser 500 containing an inlet passage 510, through which exhaust gases flow in the direction of the arrow 520. The inlet passage 510 attaches to an elongate housing 530, which describes an elongate housing of greater diameter than the inlet 510, wherein the exhaust gases expand and slow. A series of baffles 540 are disposed within the housing 530, attaching to the rear of the housing 530, guiding exhaust gas flow through a series of openings 550 disposed on the rear of the housing 530, whence exhaust gas is expelled into the atmosphere in the direction of the arrows 560.

The elongate diffuser 500 may be used in one embodiment in vertical orientation for long-haul trucks and the like using vertical exhaust stacks.

Figure 6:
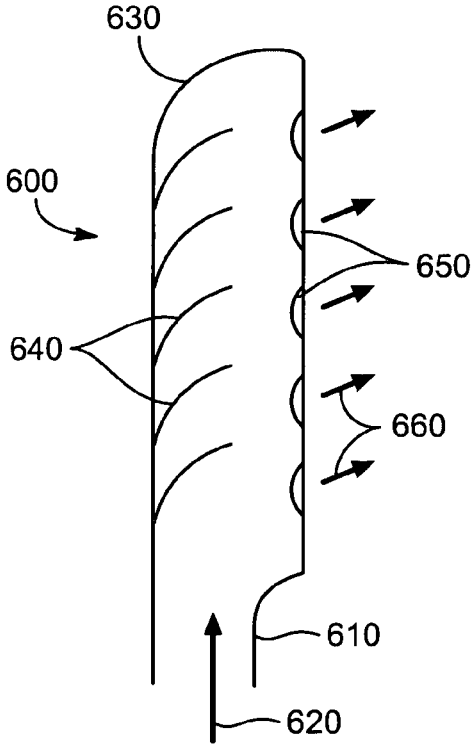
FIG. 6 is a side elevational view of another embodiment of an elongate exhaust gas diffuser according to the present invention.

FIG. 6 illustrates another embodiment of an elongate diffuser 600 according to the present invention, the diffuser 600 containing an inlet passage 610, through which exhaust gases flow in the direction of the arrow 620. The inlet passage 610 attaches to an elongate housing 630, of similar construction to the housing 530, in which the exhaust gases expand and slow. A series of baffles 640 are disposed within the housing 630, attaching to the front of the housing 630 to guide exhaust gas flow through a series of openings 650 disposed on the rear of the housing 630, the openings 650 being somewhat larger than the openings 550 in FIG. 5. Exhaust gas is expelled into the atmosphere in the direction of the arrows 660.

Figure 7:
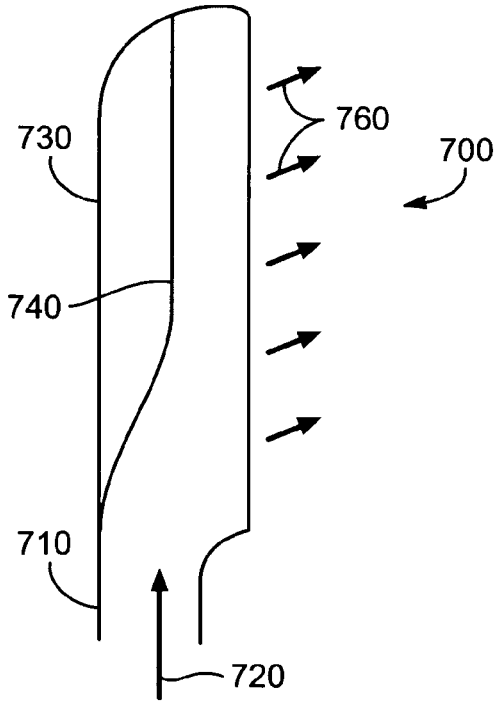
FIG. 7 is a side elevational view of another embodiment of an elongate exhaust gas diffuser according to the present invention.
Figure 8:
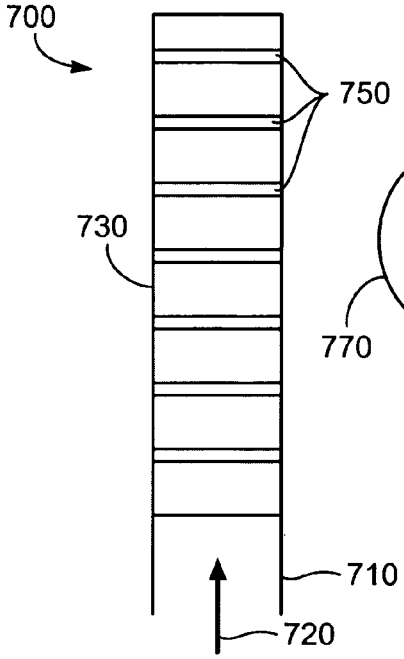
FIG. 8 is a rear elevational view of the elongate exhaust gas diffuser of FIG. 7.
Figure 8A:
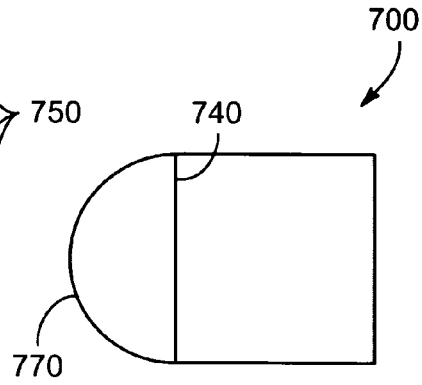
FIG. 8A is a top plan view of the elongate exhaust gas diffuser of FIG. 7.

FIGS. 7-8A illustrate another embodiment of an elongate diffuser 700 according to the present invention, the diffuser 700 containing an inlet passage 710, through which exhaust gases flow in the direction of the arrow 720. The inlet passage 710 attaches to an elongate housing 730, of similar width but greater depth than the inlet passage 710, in which the exhaust gases expand and slow. A baffle 740 attaches to the sides of the housing 730 and extends across the width of the housing 730 to guide the exhaust gas flow through a series of slots 750 disposed on the rear of the housing 730, the baffle 740 being for the purpose primarily of ensuring substantial equal flow through each slot 750. The baffle 740 bends such that it restricts the volume in the housing 730 as it approaches the distal end opposite the inlet passage 710. Exhaust gas is expelled through the slots 750 into the atmosphere in the direction of the arrows 760.

Alternatively, the front wall of the housing 730 may be formed in the shape and location of the baffle 740, accomplishing the same thing, or the baffle 740 may be eliminated, depending on the performance desired from the diffuser 700.

As can be seen by the top view shown in FIG. 8A, the front 770 of the housing 730 is shaped for aerodynamic purposes in one embodiment.

Figure 9:
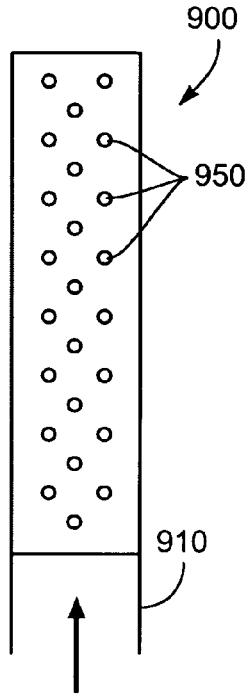
FIG. 9 is a rear elevational view of another embodiment of an elongate exhaust gas diffuser according to the present invention.

FIG. 9 illustrates another embodiment of an elongate diffuser 900 according to the present invention, being similar in construction to the diffuser 700 except that instead of slots, the diffuser 900 employs a series of apertures 950 to expel the exhaust gases to the atmosphere. Other outlet configurations are possible, the primary factor being that in their collective cross-sectional area they are greater than the cross-sectional area of the diffuser inlet 910.

Figure 10A:
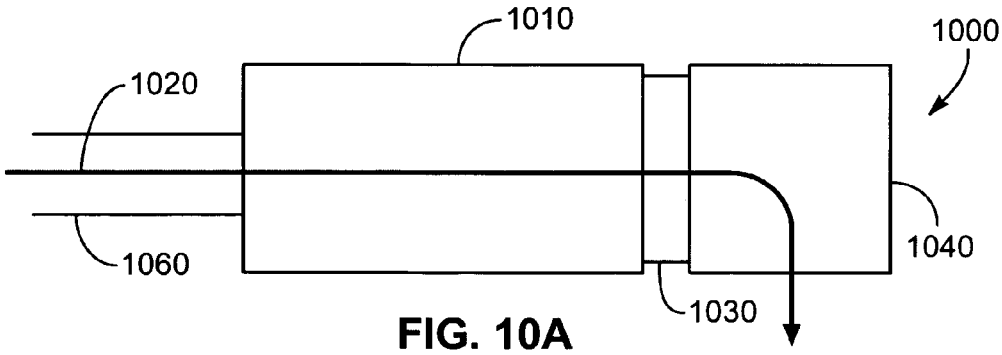
FIG. 10A is a top plan view of another embodiment of an exhaust gas diffuser according to the present invention, with the diffuser connected to an exhaust treatment device.
Figure 10B:
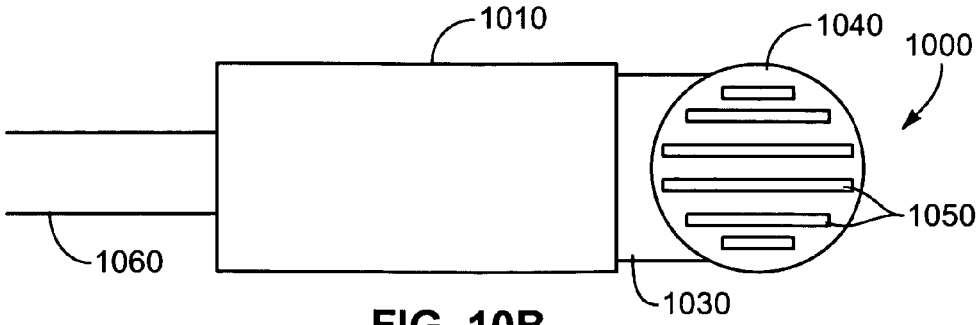
FIG. 10B is a side elevational view of the exhaust gas diffuser of FIG. 10.

FIGS. 10A and 10B illustrate another embodiment of a diffuser 1000 according to the present invention, which is directly connected to an exhaust treatment device 1010 such as a particulate filter or NOx adsorber. The exhaust flow is shown by the arrow 1020. The diffuser 1000 contains an inlet 1030 connected to the exhaust treatment device 1010, an enclosed volume housing 1040, and a series of slot openings 1050, whereby the exhaust gases escape to the atmosphere. The exhaust treatment device 1010 and housing 1040 may be considered as unitary components of a single diffuser 1000, or may be considered as separate components of the exhaust train. The diffuser 1000 illustrates that intervening components may be placed in the exhaust train between an exhaust pipe 1060 of smaller comparable volume to the housing 1040, in which the exhaust gases expand and slow, and in fact other exhaust train components may be contained entirely within the housing while remaining within the scope of the invention.

Additionally, many exhaust treatment devices are operatively constricted in cross-section through filter elements and the like, such that the actual cross-section available for the flow of exhaust is relatively small even though the outside diameter of the treatment device may be the same or larger than that of the diffuser housing.

Figure 11A:
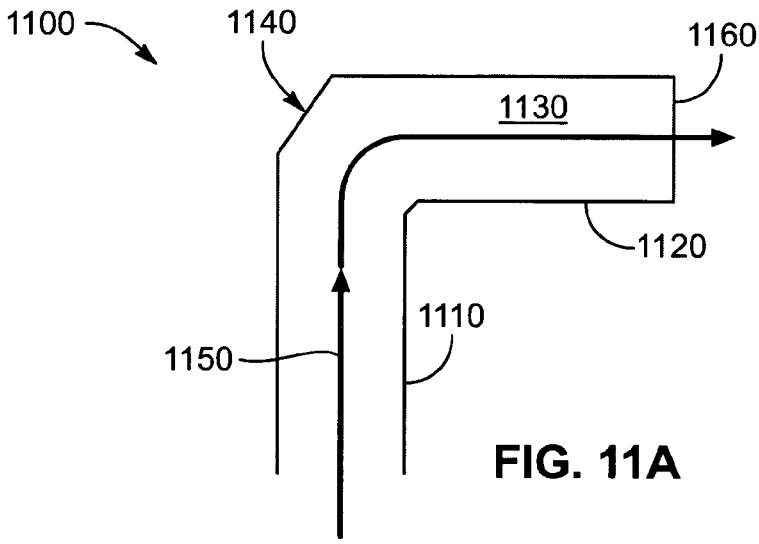
FIG. 11A is a side elevational view of another embodiment of an exhaust gas diffuser according to the present invention.
Figure 11B:
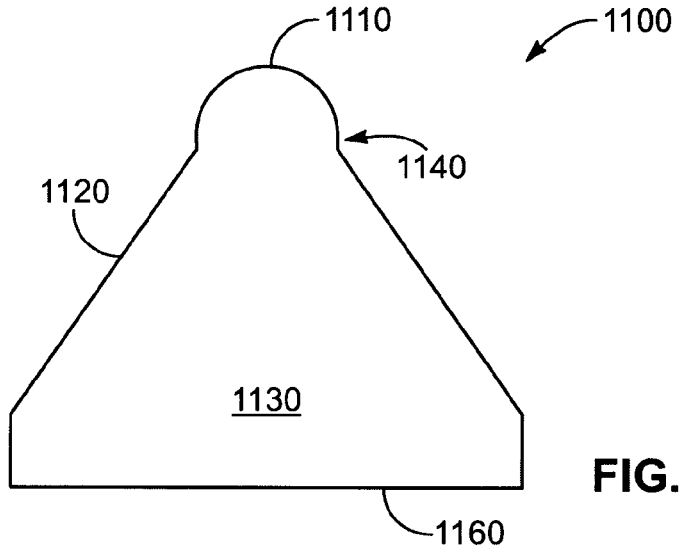
FIG. 11B is a top plan view of the diffuser of FIG. 11A.
Figure 11C:
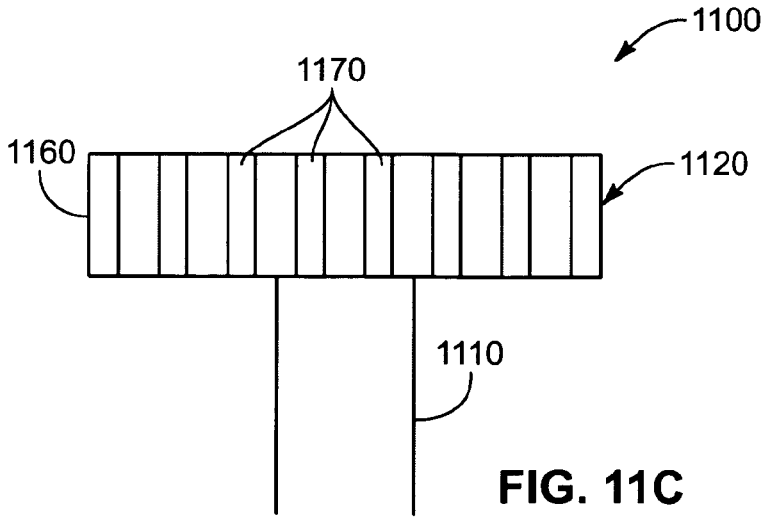
FIG. 11C is a rear elevational view of the diffuser of FIG. 11A.

FIGS. 11A, 11B, and 11C illustrate another embodiment of a diffuser 1100 according to the present invention. The embodiment shown is particularly suited for use with urban buses and other machines that have vertical exhaust tailpipes which expel the exhaust into the atmosphere at the top of the bus.

A housing 1120 defining a substantially enclosed volume 1130 attaches to the upper end of a tailpipe 1110, providing an inlet for the diffuser 1100. The housing 1120 may attach to an existing tailpipe, or the diffuser 1100 may be constructed with a unitary tailpipe that is part of the diffuser 1100 and connects to an upstream exhaust pipe or passage.

The housing 1120 is designed for placement on or near the top of an urban bus and is relatively flat, being 4-6 inches in height in one embodiment, for aerodynamic purposes and to decrease the vertical profile of the vehicle. The housing 1120 connects to the tailpipe 1110 at the front 1140 of the housing 1120 at right angles, such that the exhaust gases flowing through the tailpipe 1110 flow smoothly from the tailpipe 1110 into the enclosed volume 1130, switching from vertical to horizontal flow in the process, as shown by the arrow 1150 in FIG. 11A.

The width of the housing 1120 is approximately the same width as the tailpipe 1110 at the housing front 1140, the front 1140 being in one embodiment 4-5 inches wide, and becomes wider toward the rear 1160 of the housing 1120, the rear 1160 being 18-24 inches wide in one embodiment, such that the shape of the enclosed volume 1130 approximates a triangle as seen from above, as shown in FIG. 11B. The housing 1120 is 12-18 inches long in one embodiment.

The relatively large enclosed volume 1130 allows the exhaust gases to expand and slow as they enter the volume 1130 from the tailpipe 1110, for more ready entrainment of the exhaust gases with the atmosphere. The exhaust gases exit the housing 1120 at the housing rear 1160, through vertical slots 1170 disposed in the housing rear 1160. The slots are 1 inch wide and spaced 1-2 inches apart in one embodiment.

It will be apparent to those skilled in the art in light of this disclosure that the shape and size of the diffuser 1100 may be modified for different purposes and applications while remaining within the scope of the present invention. The housing 1120, for example, may be modified from the triangular shape shown in FIG. 11B to a rectangular, circular, or other shape suitable for the purpose. Other modifications are possible; for example, the diffuser 1110 may be modified to fit onto a school bus, which, unlike an urban bus, generally expels its exhaust through a horizontal exhaust pipe running underneath the chassis to the rear of the bus. This can be done by keeping the housing 1120 in its shown horizontal orientation and attaching it to a tailpipe, also horizontal in a school bus, such that the exhaust flows horizontally straight through the tailpipe and housing 1120, exiting the housing 1120 through the slots 1170 and entraining atmospheric gases for diffusion and cooling. The slots 1170 can also be modified to comprise different orientations, round apertures, projecting passages, or other structures. Baffles or other flow-altering structures can be placed inside the housing 1120 to redirect, streamline, or inhibit the flow of the exhaust gases through the enclosed volume 1130.

The schematic flow chart diagram that follows is generally set forth as a logical flow chart diagram. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagram, they are understood not to limit the scope of the corresponding method. Some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 12:
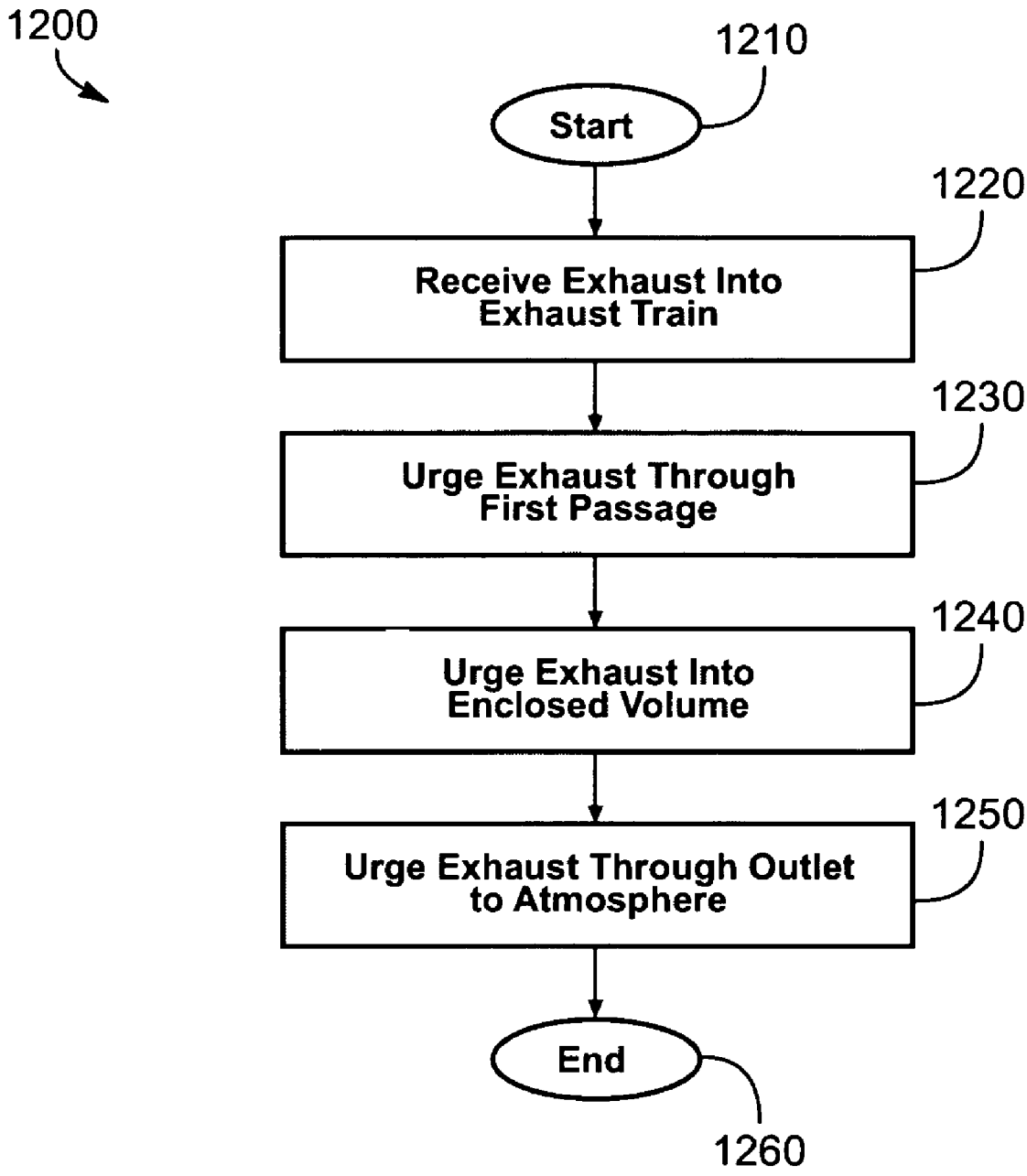
FIG. 12 is a flow chart diagram illustrating one embodiment of a method according to the present invention.

FIG. 12 illustrates one embodiment of a method 1200 of cooling exhaust gases according to the present invention. The method 1200 starts 1210, and an exhaust train receives 1220 the exhaust, which may be generated by a diesel engine or equivalent structure. The exhaust is urged through a first passage 1230, which may be an exhaust pipe or a simple inlet opening, and thence urged 1240 into an enclosed volume of comparative greater volume or cross-section than the inlet, such that the exhaust gases expand into the volume. The expanded gases then are urged 1250 through at least one outlet to the atmosphere, the outlet in one embodiment being greater in cross-section than the inlet. The method then ends 1260.

Other embodiments of the method according to the present invention may comprise additional steps such as treating the exhaust gas with a particulate filter or catalyst.

It is believed from modeling and test data that the present invention in at least one embodiment is somewhat more effective in mitigating exhaust temperature with a smaller pressure drop than at least one embodiment of the invention disclosed in the related application referenced above. However, the present invention in at least one embodiment is generally larger than at least one embodiment of the invention disclosed in the related application, making it in some cases better suited to larger engines and machines.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method of cooling exhaust gases, the method comprising:

urging the gases through a first passage;

urging the gases from an outlet of the first passage into a substantially enclosed volume, the substantially enclosed volume being elongate in a first direction extending from the first passage to a distal end of the volume, wherein the gases flow through an inlet of the volume in the first direction;

allowing the gases to expand within the volume, a portion of the volume having a cross-sectional area greater than a cross-sectional area of the outlet of the first passage;

redirecting the flow of gases through the volume from the first direction to a second direction substantially angled relative to the first direction using a plurality of baffles positioned within the elongate substantially enclosed volume, the baffles being substantially angled with respect to the first direction; and urging the gases from the enclosed volume to the atmosphere through a plurality of outlets, wherein the gases flow through the plurality of outlets in the second direction.

2. The method of claim 1, wherein the plurality of outlets are greater in collective cross-sectional area than the cross-sectional area of the outlet of the first passage.

3. The method of claim 1, further comprising slowing the collective velocity of the exhaust gases within the enclosed volume.

4. The method of claim 1, further comprising generating the exhaust gases from an internal combustion engine operatively attached to the first passage.

5. The method of claim 1, further comprising treating the exhaust gases before urging the exhaust gases into the enclosed volume.

6. An apparatus for cooling exhaust gases, the apparatus comprising:

an inlet pipe operatively connected to a source of exhaust gases, the exhaust gases being flowable through the inlet pipe in a first direction;

a housing defining a substantially enclosed volume into which a portion of the inlet pipe extends, at least a portion of the volume being larger in cross-section than the inlet pipe in cross-section, the housing configured to receive the exhaust gases through an opening formed in the portion of the inlet pipe extending into the volume, a substantial portion of the exhaust gases exiting the opening in a second direction substantially perpendicular to the first direction; and a plurality of outlets disposed on the housing and configured to expel the exhaust gases from the housing into the atmosphere, wherein a substantial portion of the exhaust gases are expelled through the plurality of outlets in a third direction substantially opposite the second direction.

7. The apparatus of claim 6, wherein the inlet pipe is configured to connect to an exhaust treatment device.

8. The apparatus of claim 6, wherein the size of the plurality of outlets is larger in cross-section than the size of the inlet pipe in cross-section.

9. The apparatus of claim 8, wherein the outlets comprise a series of apertures disposed on a side of the housing.

10. The apparatus of claim 6, wherein the plurality of outlets comprises a series of elongate slots disposed along the side of the housing, the elongate slots extending lengthwise in a direction substantially parallel to the first direction.

11. The apparatus of claim 10, wherein the cross-sectional area of the elongate volume is greater near the inlet than near the distal end.

12. The apparatus of claim 1, further comprising a baffle disposed within the housing to direct flow of the exhaust gases.

13. The apparatus of claim 12, wherein the baffle is configured to decrease the cross-sectional area of the elongate volume as the exhaust gas travels from the inlet toward a distal end opposite the inlet.

14. An exhaust pipe apparatus operatively connecting an exhaust port of an internal combustion engine to the atmosphere, the apparatus configured to carry exhaust gases from the engine to the atmosphere, the apparatus comprising:

a first passage configured to receive exhaust gases;

a housing operatively connected to the first passage for reception of exhaust gases from the passage, the housing defining a substantially enclosed volume configured such that the exhaust gases expand upon entering the housing from the first passage; and a plurality of second passages configured to expel the exhaust gases from the housing into the atmosphere, the second passages being larger in collective cross-section than the first passage;

wherein the first passage is configured to be positioned vertically and the housing is relatively flat and configured to be positioned horizontally, a front portion of the housing connecting to the first passage at approximately right angles to the first passage, the front portion of the housing being approximately the same in cross-sectional area as the first passage in cross-sectional area, the housing becoming wider and larger in cross-sectional area toward a rear portion of the housing, and wherein the second passages are disposed on the rear portion of the housing.

15. The apparatus of claim 14, wherein at least part of the housing volume is larger in cross-section than the first passage in cross-section.

16. The apparatus of claim 14, wherein the at least part of the housing volume is larger in cross-section than the second passages in collective cross-section.

17. The apparatus of claim 14, wherein the second passages comprise apertures in the housing.

18. The apparatus of claim 14, further comprising an exhaust treatment device disposed substantially within the housing.

19. The apparatus of claim 18, further comprising a baffle configured to change the direction of the exhaust gas stream.

20. A diesel engine exhaust treatment and cooling system, the system comprising:

an exhaust pipe substantially containing and directing exhaust gases generated by the engine; and a cooling mechanism disposed on the exhaust pipe and configured to receive exhaust gases from the exhaust pipe, the cooling mechanism comprising a substantially enclosed volume, a part of which is greater in cross-section than the exhaust pipe in cross-section, the cooling mechanism further comprising at least one outlet through which the exhaust gases enter the atmosphere from the substantially enclosed volume;

wherein the substantially enclosed volume comprises an elongate volume extending from an inlet to a distal end opposite the inlet, the cross-sectional area of the elongate volume being greater near the inlet than near the distal end.

21. The system of claim 20, further comprising an exhaust treatment mechanism disposed on the exhaust pipe, the exhaust treatment mechanism configured to modify the composition of the exhaust gases, and further comprising a regeneration mechanism operatively attached to the exhaust treatment mechanism, the regeneration mechanism configured to regenerate the exhaust treatment mechanism from time to time.

22. The system of claim 20, wherein the at least one outlet comprises a plurality of elongate slots each extending lengthwise in a direction substantially perpendicular to a length of the elongate volume.

23. The system of claim 20, wherein the at least one outlet comprises a plurality of outlets.

24. The system of claim 23, wherein the outlets comprise slots.

25. The system of claim 20, wherein the substantially enclosed volume is defined by an elongate housing, and further comprising a baffle disposed within the elongate housing, the baffle configured to modify the flow of the exhaust gases within the housing.

26. The system of claim 25, wherein the baffle is configured to decrease the cross-sectional area of the elongate volume as the exhaust gas travels from the inlet toward the distal end.

* * * * *